US005118172A

United States Patent [19]

Ugalde

[11] Patent Number: 5,118,172

[45] Date of Patent: * Jun. 2, 1992

[54] COMPUTER WORKSTATION

[75] Inventor: Carlos V. Ugalde, San Dimas, Calif.

[73] Assignee: Continental Engineering Group, Inc., Irwindale, Calif.

[ * ] Notice: The portion of the term of this patent subsequent to Oct. 16, 2004 has been disclaimed.

[21] Appl. No.: 496,795

[22] Filed: Mar. 21, 1990

Related U.S. Application Data

[63] Continuation-in-part of Ser. No. 233,561, Aug. 18, 1988, abandoned.

[51] Int. Cl.[5] ..... A47B 47/02

[52] U.S. Cl. ..... 312/208; 108/6; 108/102; 108/137; 108/143

[58] Field of Search ..... 108/6, 102, 50, 137, 108/143; 312/208, 196, 7.2

[56] References Cited

U.S. PATENT DOCUMENTS

| | | | |
|---|---|---|---|
| 3,151,576 | 10/1964 | Patterson | 108/6 |
| 3,246,612 | 4/1966 | Ballas | 108/6 |
| 4,313,112 | 1/1982 | Foster | 312/196 X |
| 4,428,631 | 1/1984 | Cope et al. | 312/208 X |
| 4,640,199 | 2/1987 | Zigman | 312/208 X |
| 4,657,214 | 4/1987 | Foster | 108/102 X |
| 4,681,378 | 7/1987 | Hellman | 312/107 X |
| 4,709,972 | 12/1987 | LaBudde et al. | 312/208 |
| 4,736,689 | 4/1988 | Stanko | 108/143 X |
| 4,755,010 | 7/1988 | Wilson et al. | 312/208 |
| 4,890,567 | 1/1990 | Hampshire et al. | 108/143 X |

*Primary Examiner*—Joseph Falk
*Attorney, Agent, or Firm*—Christie, Parker & Hale

[57] ABSTRACT

This invention describes a computer workstation which places the monitor below and behind the keyboard. The shelf for holding the monitor is rotatable independently of movement of a shelf for holding the keyboard. A plurality of shelves are also provided for additional equipment and supplies. In one embodiment, the workstation has separate paper supply and used paper holding shelves. In another embodiment, these shelves are combined.

27 Claims, 9 Drawing Sheets

COMPUTER WORKSTATION

This application is a continuation-in-part of U.S. Ser. No. 07/233,561, filed Aug. 18, 1988, now abandoned, and is related to design patent application Ser. No. 07/233,571, filed Aug. 18, 1988, now U.S. Design Pat. No. 311,291, issued Oct. 16, 1990.

BACKGROUND OF INVENTION

This invention relates to furniture which is used to hold computers and related equipment. More particularly, this invention relates to portable computer workstations primarily designed for an office environment.

As the use of computers continues to become more necessary, related equipment which allows for the more efficient use of computers becomes more important. Computer workstations allow multiple pieces of equipment to be in close proximity for easier use. A variety of computer workstations are currently available. While they are in varying sizes and configurations they all have many similarities. The most striking of these is that the computer monitor is invariably above the keyboard, sometimes significantly higher, as exemplified in the patents to Papich, U.S. Pat No. D284,337, and to Ugalde, U.S. Pat. No. D287,319. This configuration requires that the user must significantly change his line of sight, back and forth, in order to watch both the keyboard and the monitor. Further, in order to watch the printer, the user must often shift his chair or leave the computer entirely.

U.S. Pat. No. 4,640.19 (to Zigman) discloses a computer workstation with a horizontally adjustable keyboard supporting shelf. A monitor supporting shelf is coupled to the keyboard shelf so that it moves to a horizontal position when the keyboard is being pulled out, and an inclined position when the keyboard is pushed inward. The user cannot set an optimal viewing angle of the monitor and keyboard and an optimal reaching distance to the keyboard as the keyboard and monitor supporting shelves are linked together.

SUMMARY OF THE INVENTION

The present invention provides a computer workstation which allows the computer and its related equipment to be used more efficiently and comfortably. In the present invention, a workstation has a monitor shelf located below and behind the keyboard shelf. This puts the monitor and the keyboard in nearly the same line of sight and minimizes the effort needed to watch both of them during use. The monitor shelf's angular position is adjustable independently of the keyboard shelf, so that the line of sight can be optimized for different users and different keyboard positions.

Preferably, three shelves are included and adapted for use with a printer. The top shelf has a slot and an upper shelf located below the slot in the top shelf is used to hold the blank paper, which can be fed up through the slot or around the back of the top shelf, depending on the type of printer used. A second upper shelf is horizontally movable so that it can extend beyond the back of the workstation to receive the printed paper.

To increase the usefulness of the workstation, additional shelves are added. In addition, the workstation is fitted with casters so that it is more easily movable.

According to the invention there is provided a computer workstation having a front and a rear. The workstation comprises a pair of side walls having at least one element extending between the side walls and secured thereto. The workstation also includes a keyboard shelf disposed between and supported by the side walls and a monitor shelf also disposed between and supported by the side walls. The monitor shelf is upwardly inclined toward the front of the workstation and is positioned below the keyboard shelf such that the vertical distance from the front edge of the monitor shelf to the plane of the keyboard shelf is less than the overall height of the monitor. Also provided are means for adjusting the keyboard shelf in the horizontal direction and means for adjusting the angle of the inclination of the monitor shelf, both adjusting means being independent of each other so that the keyboard shelf may be adjusted horizontally without affecting the horizontal location and adjustability of the monitor shelf.

DETAILED DESCRIPTION OF INVENTION

Figure 1:
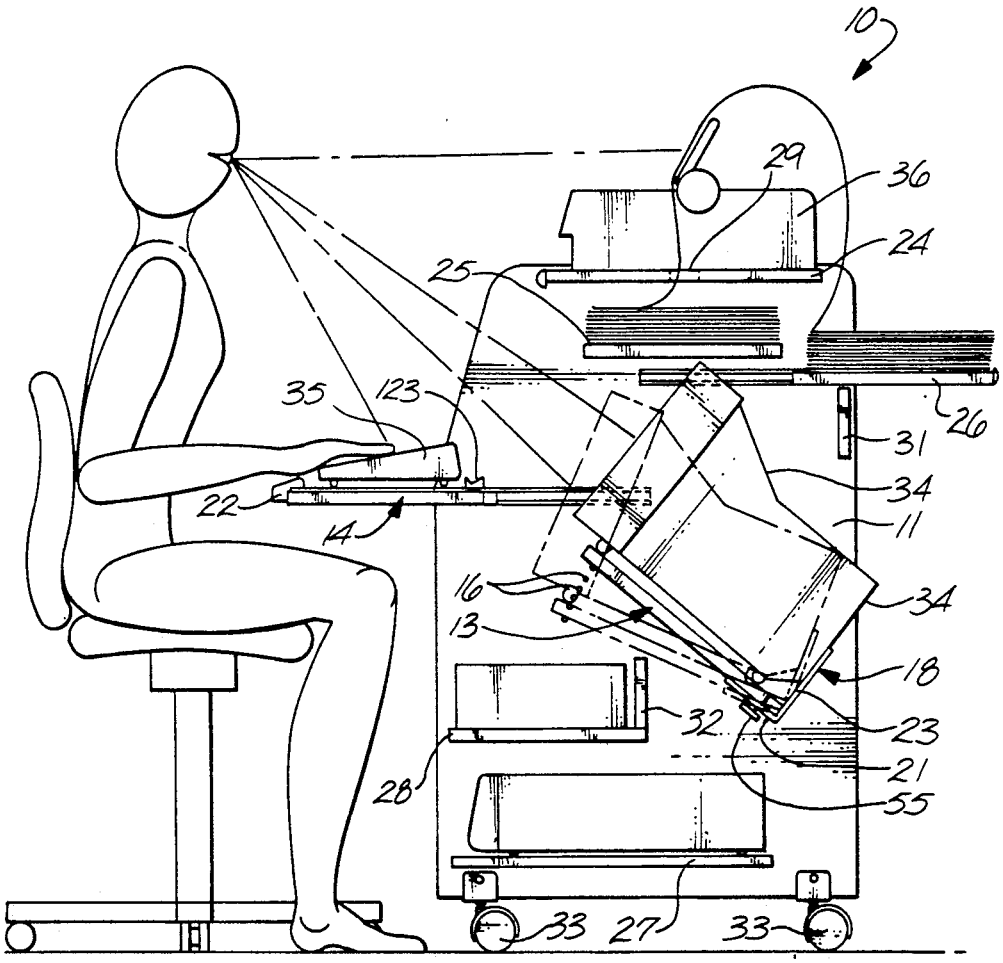
FIG. 1 is a sectional side view of a computer workstation to the present invention.
Figure 2:
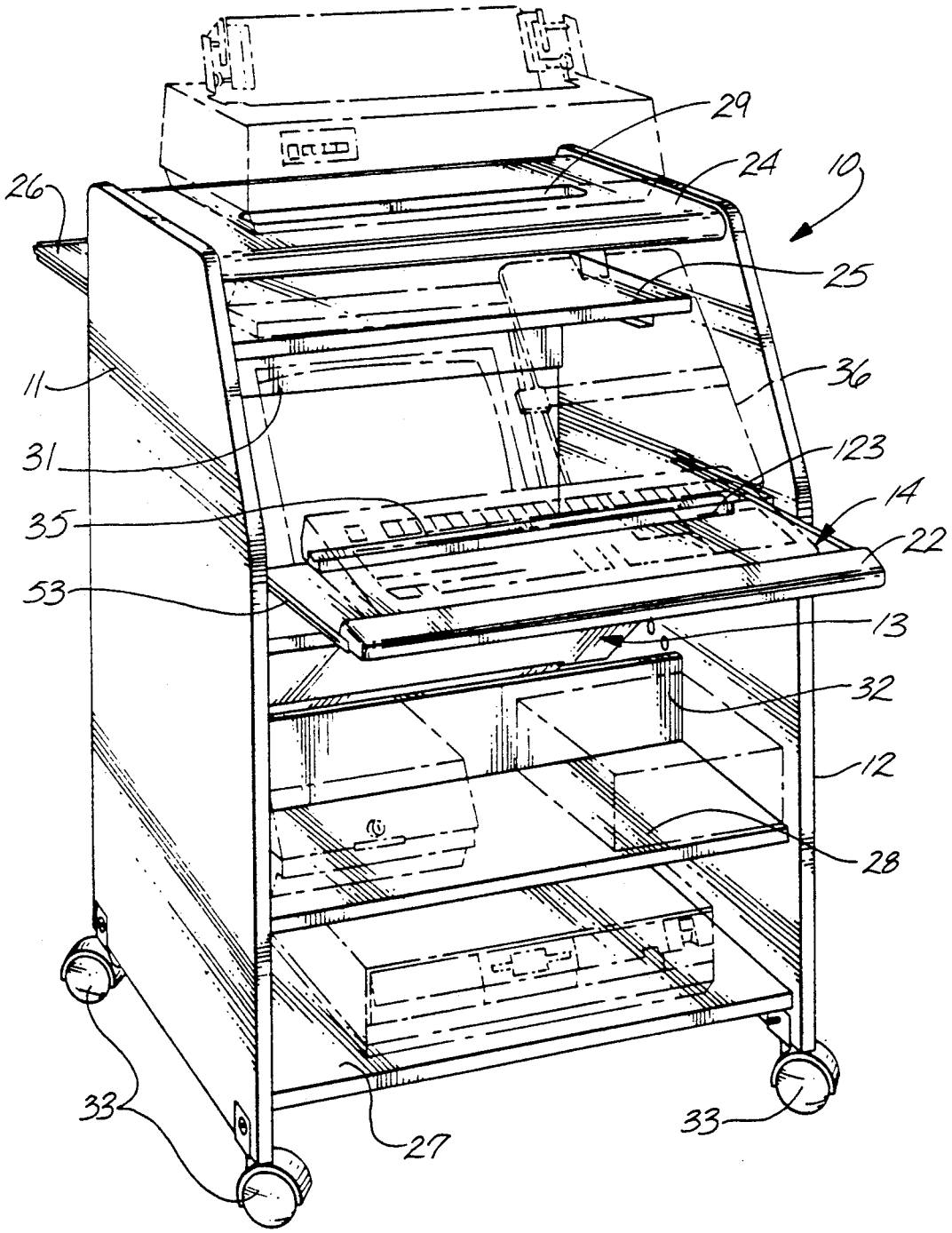
FIG. 2 is a front perspective view of a computer workstation to the present invention.
Figure 3:
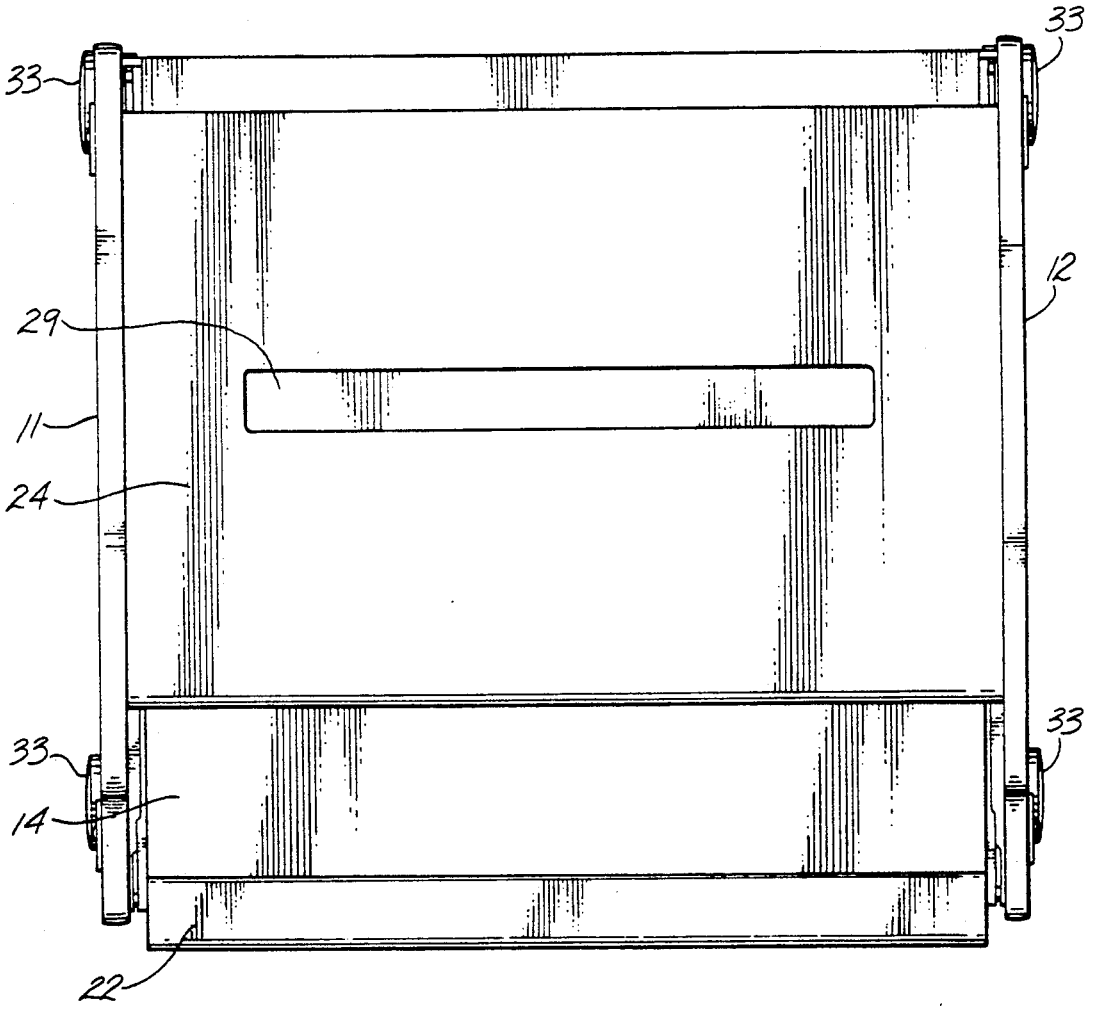
FIG. 3 is a top view of the workstation.

Referring to FIGS. 1 and 2, a computer workstation 10 according to the present invention is shown which comprises two vertical side walls, 11 and 12, a monitor shelf 13, and a keyboard shelf 14. The side walls are elongated, with the upper front portion of each side wall tapered and angled back toward the rear of the unit. The monitor shelf 13 is located generally towards the rear of the workstation with its forward edge at a higher elevation than its rear edge. The keyboard shelf 14 is generally horizontal and positioned adjacent the front of the workstation. As can be seen in FIGS. 1 and 2, the keyboard shelf is positioned above the front edge of the monitor shelf and spaced from the monitor shelf a distance less than the overall height of the monitor. Thus, the vertical distance from the front edge of the monitor shelf to the plane of the keyboard shelf is less than the overall height of the monitor. Preferably, the workstation has four casters 33, one on each bottom corner, so that it is easily movable.

The position of the monitor 34 is adjustable both as to its angle of inclination and its spacing from the front of the workstation. The angle is determined by the angular positioning of the monitor shelf. One end of the monitor shelf is pivotally connected to the side walls by pins 15, allowing the other end to pivot about the axis defined by the pins. Pairs of corresponding apertures 16 are located in each side wall interior surface in an arc formation which traces the allowable movement of the swinging end of the monitor shelf. Pin supports 17 are placed in a corresponding pair of apertures 16 so that they extend from the interior surface of the side walls and underneath the monitor shelf. To adjust the angle of the monitor shelf, the pin supports 17 are moved to a different pair of apertures. In the preferred embodiment, the pins 15 are located near the rear of the monitor shelf while the pin supports 17 are near the front.

Figure 4:
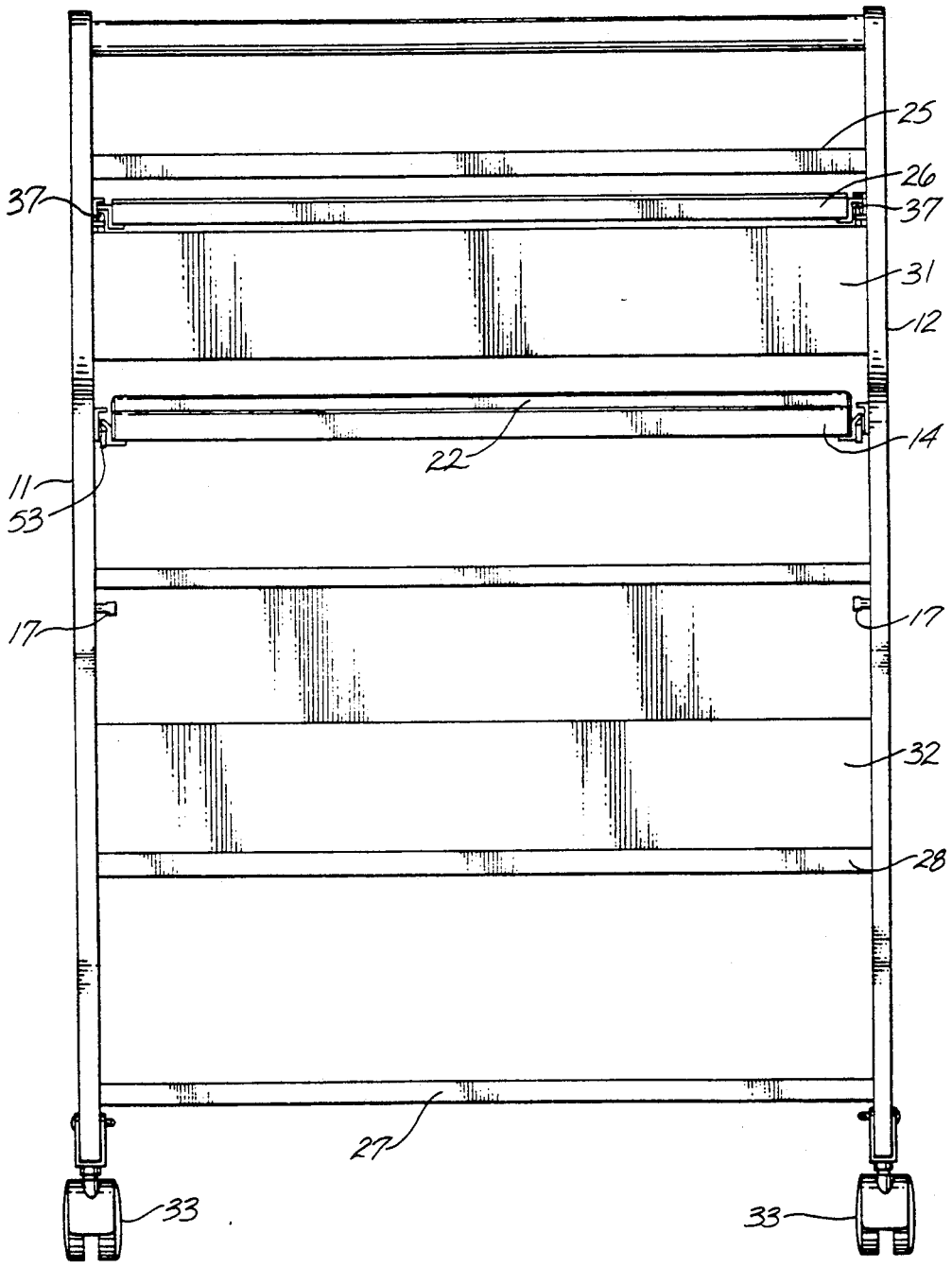
FIG. 4 is front view thereof with a monitor shelf omitted for clarity.
Figure 4A:
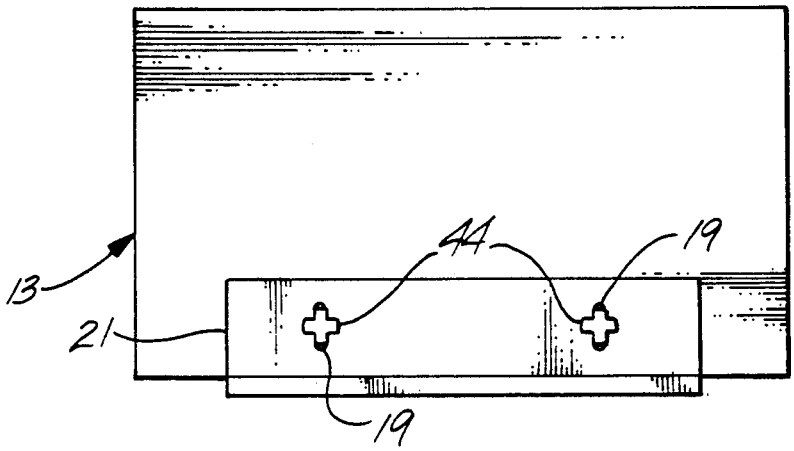
FIG. 4*a* is a view of the underside of the monitor shelf at an normal to the shelf.

The monitor 34 is held in position on the shelf by an L-shaped brace 18, which is attached to the rear of the monitor shelf 13. The brace is arranged such that the inner side of the one leg (base portion) 21 fits snugly against the lower side of the monitor shelf and is provided with two elongated slots 19, as is best shown in FIG. 4*a*. The other leg (upright portion) 23 extends upwardly thus supporting the monitor as the monitor is seated against this leg. Two threaded holes 51 are provided on the bottom side of the monitor shelf each corresponding to one of the slots 19. A pair of knobbed screws 44 extend through the slots and engage each threaded hole. The position of the brace 18 is determined by sliding it back and forth along the slots and tightening knobbed screws 44 at the desired location.

The keyboard shelf 14 is positioned above the monitor shelf 13. In the preferred embodiment shelves 13, 14 are positioned so that the monitor and the keyboard are within a narrow angle of view to a person working at the computer station. The keyboard shelf is attached by horizontally sliding brackets 53 which allow the shelf to extend outwardly from the front of the side walls, making the keyboard easier to use. In addition, the keyboard shelf has a wrist rest 22 which extends along the top of its front edge, providing greater comfort for the user.

The invention further includes a plurality of shelves 24, 25, 26, 27 and 28 which can be arranged in a variety of configurations. In the embodiment as shown, there are five additional shelves: a top shelf 24, attached to the side walls near the top of the workstation; a first upper shelf 25 attached to the side walls just below the top shelf; a second upper shelf 26 attached to the side walls just below the first upper shelf and above the keyboard shelf and which shelf 26 is horizontally slidably adjustable; a bottom shelf 27 attached to the side walls near the bottom of the workstation; and a lower shelf 28 attached to the side walls just above the bottom shelf and generally below and in front of the monitor shelf.

For use with a bottom feed printer 26, the top shelf 24 has a slot 29 to allow paper stored on the first upper shelf 25 to feed up to the printer. For a rear feed printer, the paper stored on the upper shelf loops around the rear end of the top shelf. In either case, the second upper shelf 26 is attached to the side walls by horizontally adjustable sliding brackets 37 which allow it to extend past the rear of the side walls to receive paper as it comes out of the printer. This allows the shelf 26 to accommodate a large amount of paper, even though it is closely spaced with the shelf 25. For greater lateral support, a brace 31 is added just below the upper shelves which extends from one side wall to the other.

The lower shelf 28 is positioned so that the monitor shelf 13 is both above and behind it. Thus shelf 28 extends only partially to the rear of the workstation. A vertical bar 32 which is attached to the rear edge of the lower shelf is also provided. Bar 32 extends upwardly, forming an L-shape with shelf 28 to hold objects on the shelf. Bottom shelf 27 is attached near the bottom of the side walls and above the casters but below the monitor shelf. This shelf extends the full depth of the workstation providing enough space for a computer (CPU) or a similar piece of equipment.

Additionally, a document holder 26 is optionally provided which fits into a document holder rail 123. The document holder rail 123 runs along the top of rear edge of the keyboard shelf. The document holder fits on to the rail and leans back against upper shelf 25. The document holder is then placed to one side of the keyboard shelf and the monitor is placed to the other side of the monitor shelf. Thus, the keyboard, the monitor, and any document on holder 36 are all within a narrow field of vision.

Figure 10:
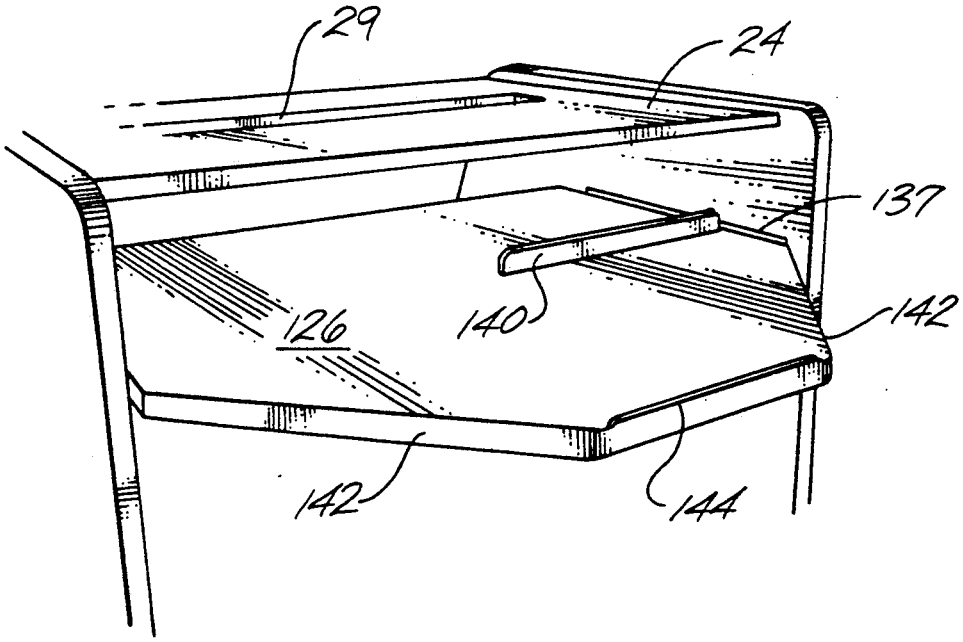
FIG. 10 is a partial perspective view of a paper holding shelf according to the workstation of FIG. 8.
Figure 5:
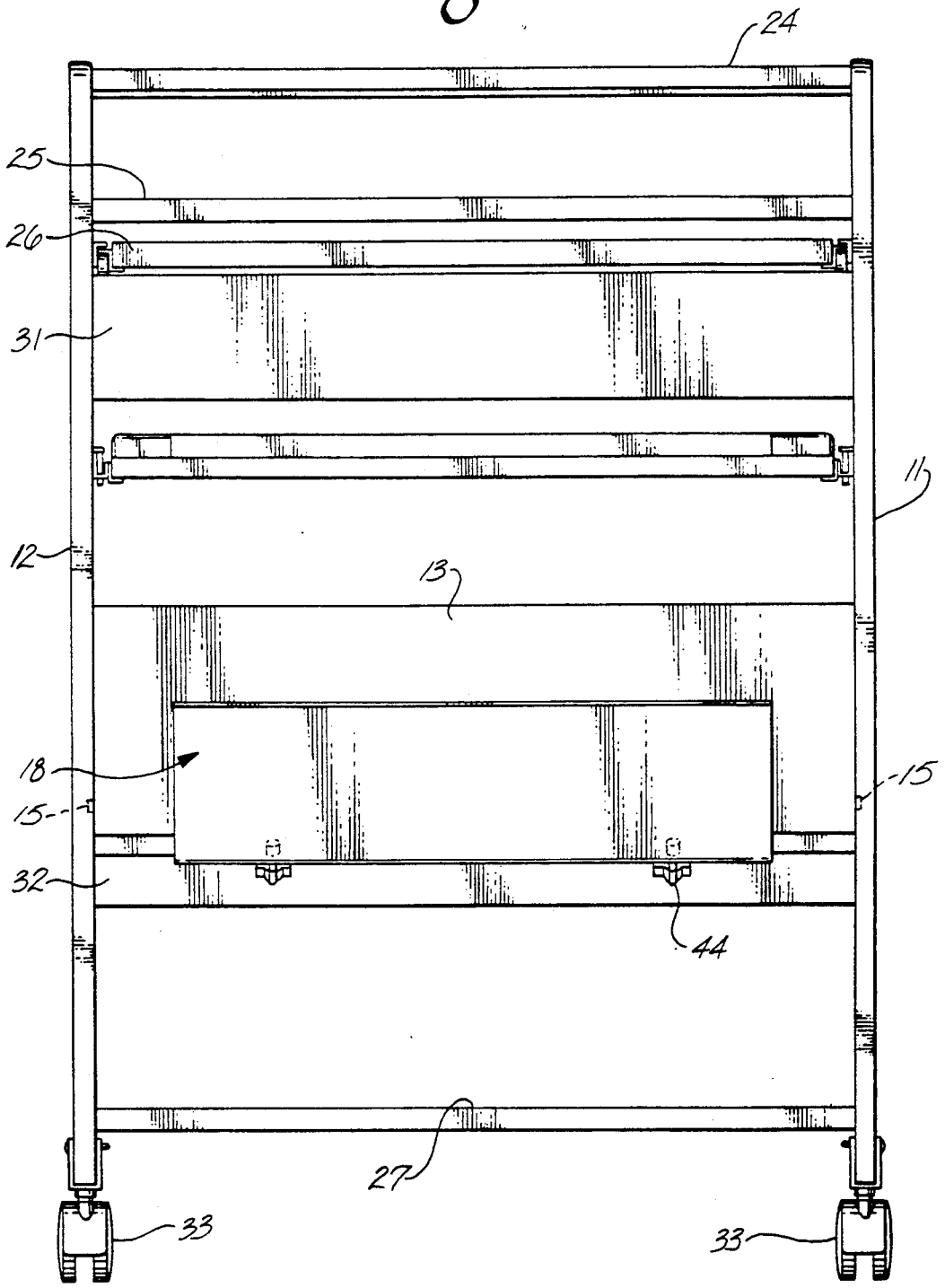
FIG. 5 is a rear view thereof of the workstation.
Figure 6:
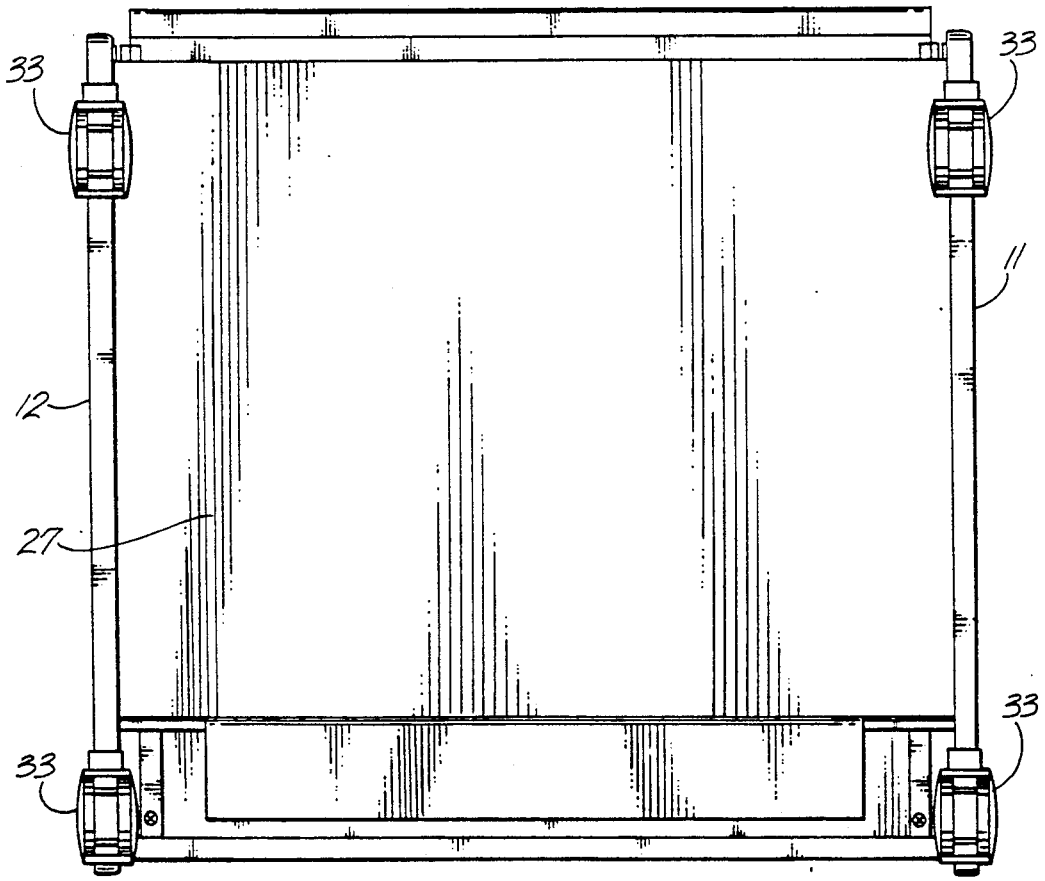
FIG. 6 is a bottom view thereof.
Figure 7:
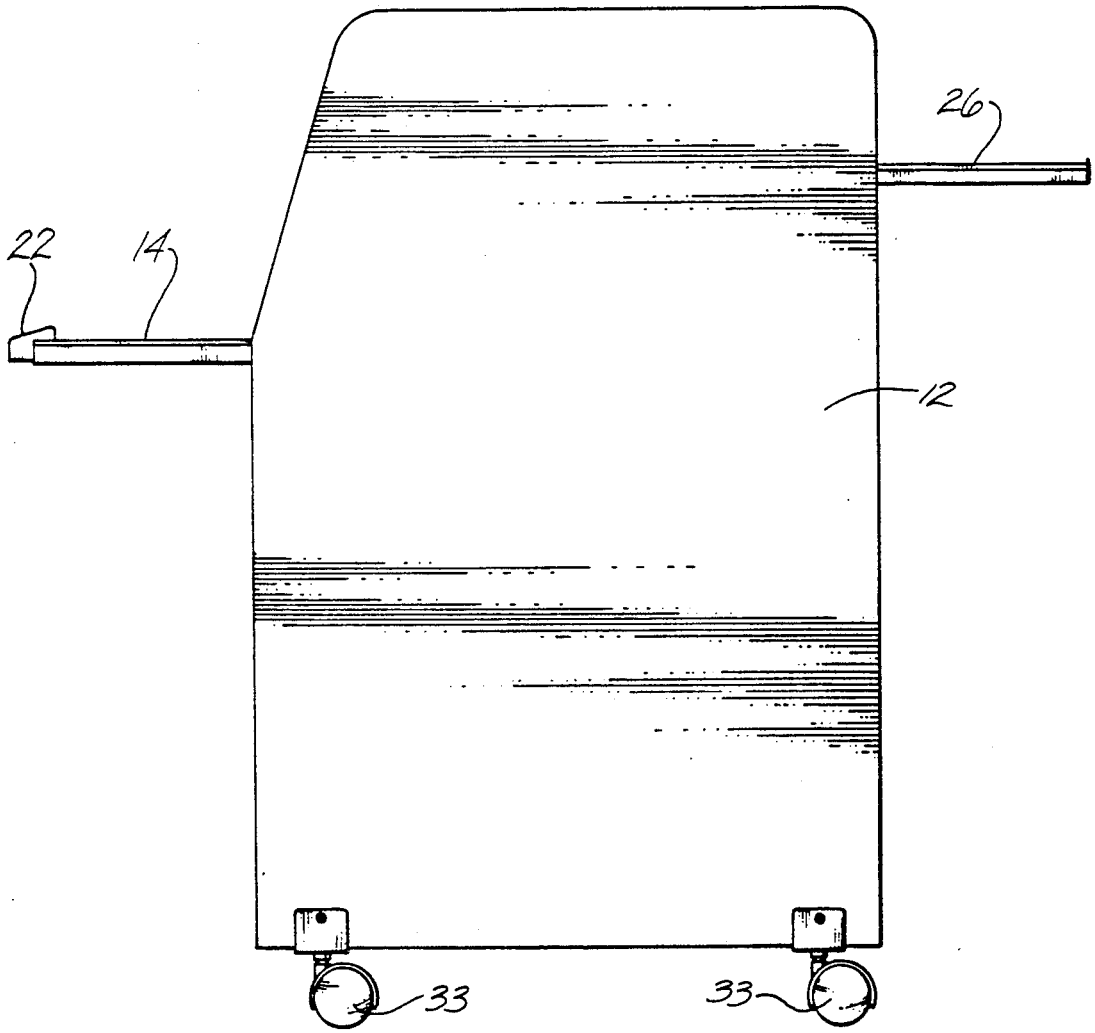
FIG. 7 side view thereof with the keyboard and paper shelves extended out of the workstation.
Figure 8:
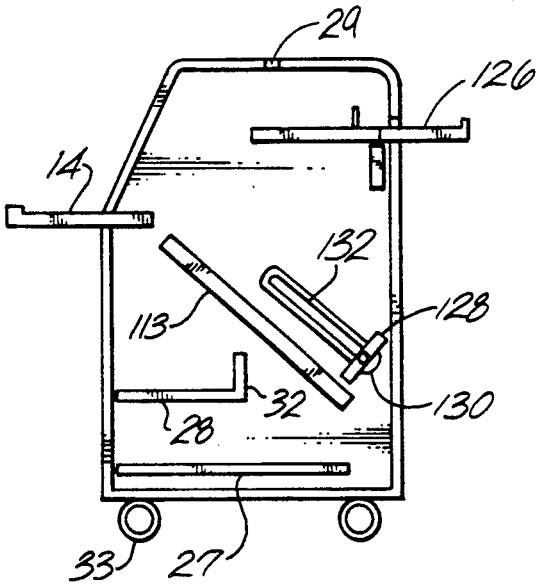
FIG. 8 is a schematic side view of a computer workstation, with a side panel removed, according to another of the invention.
Figure 9:
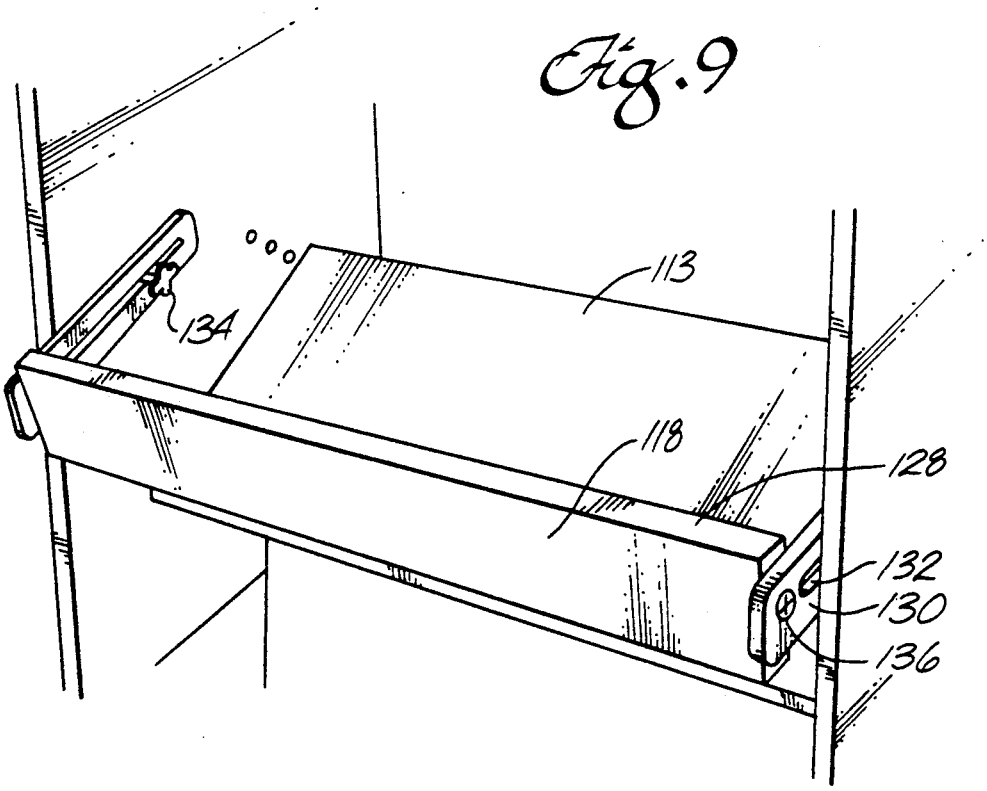
FIG. 9 is a partial perspective view of a monitor shelf to the workstation of FIG. 8.

Another embodiment of the workstation according to the invention is shown in FIGS. 8–10, in which like elements have like reference numerals.

FIG. 8 shows a schematic side view of the workstation of this embodiment with the rear side panel removed. The workstation is the same as that of the embodiment of FIG. 1 except that the monitor shelf bracket 118 (18) and the first and second upper shelves (25, 26) are modified. In this embodiment, as best shown in the partial perspective view of FIG. 9, monitor shelf bracket 118 is independent of monitor shelf 113. Bracket 118 has a rear panel 128, two telescoping arms 130 with elongate slots 132, knobbed screws 134 for attaching each arm 130 to each side panel 11, 12 and lag screws or bolts 136 for attaching each arm 130 to the rear panel. This construction allows the panel 128 to slide back and forth to accommodate different size monitors and to place the monitor at an optimal distance from the viewer's eyes. The panel also is rotatable about the screws 136 (due to the smooth surface of the preferably plastic arms 130) and may also rotate with respect to the shelf 113 to accommodate the rear shape of the monitor. The separation of the panel 128 and shelf 113 also accommodates cables from the monitor.

In addition, with reference to FIG. 10, which is a partial perspective view of a sole upper shelf 126, this sole shelf replaces both shelves 25 and 26 of the embodiment of FIG. 1. Shelf 126 support both paper supply and used paper.

A separator 140 avoids entanglement of the paper supply and used paper stacks. The rear of the shelf has angled edges 142, preferably at 45°, so that if the unit is placed in a corner at 45, to the walls, the shelf fits into the corner. This shelf is slidably mounted on horizontally adjustable sliding brackets 137, substantially the same as brackets 37. Brackets 137 are constructed so that shelf 126 not only moves rearward to collect used paper but also can move forward to a position where it can protect a monitor screen from overhead glare. The shelf also has a small lip 144 across its rear edge 146 to prevent used paper from sliding off.

The preceding embodiment is intended as an example of the present invention. There are many variations which are within the spirit of this invention. The size and shape of the workstation are to some extent determined by the specific equipment being accommodated and the environment in which it is used. It can also be made from a variety of materials including wood, pressed wood, plastic, and metal.

What is claimed is:

1. A computer workstation having a front and rear comprising:

a pair of side walls having at least one element extending therebetween and secured to the side walls;

a first shelf for holding a video monitor, said first shelf being supported by and disposed between the side walls, said first shelf being inclined such that an edge of the first shelf adjacent the front of the workstation is higher than a rear edge of the first shelf;

a second shelf for holding a keyboard disposed and supported between the side walls, said second shelf being positioned a predetermined spacing above the front edge of the first shelf; the dimensional spacing of the second shelf above the front edge of the first shelf being less than the overall height of the monitor;

first adjustable means for adjusting the angle of inclination of the first shelf; and second adjustable means for adjusting the horizontal position of the second shelf;

said first and second shelves being movable and adjustable independently of each other to enable separate adjustment of the angle of inclination of the first shelf and the horizontal position of the second shelf so that the line of sight to a monitor on the first shelf and the horizontal location of the keyboard on the second shelf can be variably and separately adjusted.

2. A computer workstation as defined in claim 1 wherein the second adjustable means is horizontally adjustable, such that the second shelf is capable of extending beyond the front of the workstation side walls.

3. A computer workstation as defined in claim 1 further comprising a top shelf which is attached between the side walls above the second shelf proximate the top of the workstation.

4. A computer workstation as defined in claim 3 wherein the top shelf has a slot removed from it, and further comprising an upper shelf which is attached between the side walls, and disposed below the slot of the top shelf and above the second shelf.

5. A Computer workstation as defined in claim 4 including an additional upper shelf which is located above the second shelf and is movably attached between the side walls by horizontally adjustable means which allow the additional upper shelf to extend beyond the rear of the workstation side walls.

6. A computer workstation as defined in claim 1 further comprising a brace attached near the rear of the side walls.

7. A computer workstation as defined in claim 1 further comprising, a lower shelf having a rear end and being attached between the side walls below the first shelf, a brace attached to both side walls, located snugly against the rear end of the lower shelf and extending upwards from the lower shelf, so as to form an L-shape with the shelf.

8. A computer workstation as defined in claim 1 further comprising a bottom shelf attached between the side walls below the first shelf and adjacent the bottom of the workstation.

9. A computer workstation as defined in claim 1 further comprising four casters, two of which are attached at spaced intervals at the bottom of each side wall.

10. A computer workstation as defined in claim 1 wherein a front of each side wall angles back as it approaches the top.

11. A computer workstation as defined in claim 1 further comprising a wrist rest which extends along the top of a front edge of the second shelf.

12. A computer workstation as defined in claim 1 further comprising, a document holder rail which extends along the top of a rear edge of the second shelf, a document holder which fits on to the document holder rail.

13. A computer workstation as defined in claim 1 further comprising means for supporting the monitor on the first shelf which means are attached adjacent the rear edge of the first shelf wherein the means for supporting the monitor provides for varying the depth at which the monitor sits on the first shelf and comprises, a brace having two legs forming an L-shape, wherein an inner surface of one of the legs fits snugly against the bottom of the first shelf, which one leg has two slots formed in it, and the other leg of the brace extends upward beyond a top surface of the first shelf; and two screws which each fit snugly through a respective one of the slots in the one of the legs for being threaded snugly into the bottom of the first shelf wherein the screws are adjustable for moving the brace toward at least one of the rear edge and the front edge of the first shelf to vary the depth at which the monitor sits.

14. A computer workstation having a front and rear comprising:

a pair of side walls having at least one element extending therebetween and secured to the side walls;

a keyboard shelf disposed between and supported by the side walls;

a monitor shelf disposed between and supported by the side walls, the monitor shelf being upwardly inclined toward the front of the computer workstation; the monitor shelf being positioned below the keyboard shelf such that the vertical distance from the front edge of the monitor shelf to the plane of the keyboard shelf is less than the overall height of the monitor;

first means for adjusting the location of the keyboard shelf in the horizontal direction; and second means for adjusting the angle of inclination of the monitor shelf;

said first and second means being independent of each other so that the keyboard shelf may be adjusted horizontally without affecting the horizontal location and adjustability of the monitor shelf.

15. A computer workstation as defined in claim 14 further comprising a top shelf supported between the side walls for supporting a printer and an upper shelf for supporting paper for feeding to the printer and receiving paper from the printer, the upper shelf being disposed between the side walls below the top shelf and above the keyboard shelf, and means for adjusting the horizontal position of the upper shelf toward a front of the side walls and beyond a rear of the side walls.

16. A computer workstation as defined in claim 15 wherein the upper shelf has first upright means for separating paper fed to the printer from used printer paper and second upright means proximate a rear edge of the upper shelf for retaining paper on the upper shelf.

17. A computer workstation as defined in claim 15 wherein the upper shelf has a front edge, two sides and a rear portion having two angled edges each contiguous with and at about 45° to the sides, respectively, and a rear edge extending between the two angled edges and parallel to the front edge.

18. A computer workstation as defined in claim 14 further comprising a bracket for supporting a rear portion of the monitor, the bracket having a panel extending between the side walls and disposed above the monitor shelf so as to define a gap therebetween, and means for fixing the panel to the side walls for rotation with respect thereto and for horizontal adjustment with respect to the monitor shelf.

19. A computer workstation as defined in claim 18 wherein the means for fixing the panel comprises two elongate arms each having an elongate slot defined therein, a knobbed screw extending through the slot for fixing each arm to a respective one of the side walls, and another screw for fixing each arm to a respective side of the panel.

20. A workstation in combination with a computer having a monitor, a keyboard, a CPU and a printer, the workstation having a front and rear and comprising:

a pair of side walls;

a top shelf and a bottom shelf extending between and fixed to the side walls, the top shelf supporting the printer and the bottom shelf supporting the CPU;

a first shelf supported between the side walls and between the top shelf and the bottom shelf, the first shelf supporting the keyboard, and means for horizontally adjusting the position of the first shelf; and a second shelf located below the first shelf and inclined upward toward the front of the workstation, the second shelf supporting the monitor for viewing between the top shelf and the first shelf, the front edge of the second shelf being spaced below the first shelf a distance less than the height of the monitor; and means for pivotably attaching the second shelf proximate a rear edge thereof to the side walls to adjust the angle of inclination of the second shelf independently of horizontal adjustment of the first shelf, said means for horizontally adjusting the position of the first shelf being independent of the second shelf so that the position of the first shelf may be adjusted without changing the horizontal position of the second shelf.

21. A workstation in combination with a computer as defined in claim 20, further comprising a first upper shelf disposed immediately below the top shelf for supporting paper for supply to the printer, the top shelf having a slot formed therein adapted for paper to pass to the printer, and a second upper shelf disposed immediately below the first upper shelf for supporting used paper, and means for horizontally adjusting the position of the second upper shelf to extend past the rear of the side walls.

22. A workstation in combination with a computer as defined in claim 20, further comprising a document holder and means for supporting the document holder on the keyboard shelf with the monitor viewable to one side of a document supported on the document holder.

23. A combination of a computer workstation and a computer:

said computer comprising a monitor, a keyboard, a CPU, and a printer;

said workstation having a front and rear and comprising:

a pair of side walls, a top shelf and a bottom shelf extending between and fixed to the side walls, the top shelf supporting the printer and the bottom shelf supporting the CPU, a keyboard shelf for supporting the keyboard, said keyboard shelf being supported between the side walls and disposed between the top shelf and the bottom shelf;

means for adjusting the horizontal position of the keyboard shelf, a monitor shelf for supporting the monitor inclined upwardly toward the front of the workstation, said monitor shelf being supported between the side walls and inclined so that the front and rear edges thereof are positioned below the keyboard shelf and above the bottom shelf to enable viewing of the monitor between the top shelf and the keyboard shelf, the front edge of the monitor shelf being spaced a vertical distance below the keyboard shelf which is less than the overall height of the monitor, means for adjusting the angle of inclination of the monitor shelf relative to the side walls, said keyboard shelf and said monitor shelf being unconnected to each other so that the horizontal position of the keyboard shelf may be adjusted without changing the horizontal position of the monitor shelf.

24. A workstation in combination with a computer as defined in claim 23, further comprising a first upper shelf disposed immediately below the top shelf for supporting paper for supply to the printer, the top shelf having a slot formed therein adapted for paper to pass to the printer, and a second upper shelf disposed immediately below the first upper shelf for supporting used paper, and means for horizontally adjusting the position of the second upper shelf to extend past the rear of the side walls.

25. A workstation in combination with a computer as defined in claim 24, further comprising a document holder and means for supporting the document holder on the keyboard shelf with the monitor viewable to one side of a document supported on the document holder.

26. A computer workstation comprising:

a pair of side walls having at least one element extending therebetween and secured to the side walls;

a first shelf for holding a video monitor, the first shelf being disposed between the side wall sand inclined such that an edge of the first shelf adjacent the front of the workstation is higher than a rear edge of the first shelf;

a second shelf for holding a keyboard disposed between the side walls and positioned above the first shelf;

first adjustable means for attaching the first shelf to the side walls for movement independently of the second shelf; and second adjustable means for attaching the second shelf to the side walls for movement independently of the first shelf, wherein the first adjustable means comprises means for supporting the first shelf for rotation about an axis located adjacent the rear edge of the first shelf and adjustable supporting means disposed proximate the front edge of the first shelf for adjustably supporting the front edge of the first shelf.

27. A computer workstation as defined in claim 26 wherein, each of the side walls has corresponding apertures formed in it and arranged in an arc formation, and the adjustable supporting means comprises pins which fit into each of the apertures respectively thus supporting the first shelf.

* * * * *

UNITED STATES PATENT AND TRADEMARK OFFICE

CERTIFICATE OF CORRECTION

PATENT NO. : 5,118,172

DATED : June 2, 1992

INVENTOR(S) : Carlos V. Ugalde

It is certified that error appears in the above-identified patent and that said Letters Patent is hereby corrected as shown below:

ON THE TITLE PAGE:

Abstract, line 7, change "supply" to -- supplies --.

Column 1, line 10, before "INVENTION" insert -- THE --.
Column 1, line 32, change "4,640,19" to -- 4,640,199 --.

Column 2, line 18, before "DRAWINGS" insert -- THE --.
Column 2, line 20, after "workstation" insert -- according --.
Column 2, line 22, after "workstation" insert -- according --.
Column 2, line 27, before "normal" insert -- angle --.
Column 2, line 30, before "side" insert -- is a --.
Column 2, line 33, after "another" insert -- embodiment --.
Column 2, line 40, before "INVENTION" insert -- THE --.

Column 4, line 5, before "rear" insert -- the --.
Column 4, lines 6,7, change "on to" to -- onto --.
Column 4, line 40, change "support" to -- supports --.
Column 4, line 45, change "45" to -- 45° --.

UNITED STATES PATENT AND TRADEMARK OFFICE

CERTIFICATE OF CORRECTION

PATENT NO. : 5,118,172

DATED : June 2, 1992

INVENTOR(S) : Carlos V. Ugalde

It is certified that error appears in the above-identified patent and that said Letters Patent is hereby corrected as shown below:

In the Claims

Column 6, line 3, change "on to" to -- onto --.

Signed and Sealed this

Twenty-fifth Day of January, 1994

*Attest:*

*Attesting Officer*

BRUCE LEHMAN

*Commissioner of Patents and Trademarks*